US006173871B1

(12) United States Patent
Woodworth

(10) Patent No.: US 6,173,871 B1
(45) Date of Patent: Jan. 16, 2001

(54) GARMENT HANGERS

(76) Inventor: Peter Michael Woodworth, 3 Camrose Close, Connah's Quay, Flintshire. Clwyd. CH5 4TL (GB)

( * ) Notice: Under 35 U.S.C. 154(b), the term of this patent shall be extended for 0 days.

(21) Appl. No.: 09/529,123

(22) PCT Filed: Oct. 6, 1998

(86) PCT No.: PCT/GB98/02986

§ 371 Date: Apr. 6, 2000

§ 102(e) Date: Apr. 6, 2000

(87) PCT Pub. No.: WO99/17644

PCT Pub. Date: Apr. 15, 1999

(30) Foreign Application Priority Data

Oct. 6, 1997 (GB) ..... 9721102

(51) Int. Cl.[7] ..... A47G 25/62
(52) U.S. Cl. ..... 223/94; 223/95
(58) Field of Search ..... 223/85, 94, 89, 223/95, 88

(56) References Cited

U.S. PATENT DOCUMENTS

| | | | | |
|---|---|---|---|---|
| 2,477,873 | * | 8/1949 | Hopkins et al. | 223/94 |
| 4,391,395 | * | 7/1983 | Karner | 223/94 |
| 5,044,535 | * | 9/1991 | Hunt | 223/95 |
| 5,397,038 | * | 3/1995 | Hunt | 223/95 |
| 5,511,701 | * | 4/1996 | Lam | 223/85 |

* cited by examiner

*Primary Examiner*—Bibhu Mohanty
(74) *Attorney, Agent, or Firm*—Olson & Hierl, Ltd.

(57) ABSTRACT

Disclosed is a garment hanger having a generally central portion and garment support arms extending therefrom, the support arms each having a movable part slidably connected to the central portion for reciprocal movement to increase or decrease the length of the arms, wherein the movable parts of the arms are connected by a flexible link member such that extending movement of one movable part causes extending movement of the other moving part.

23 Claims, 10 Drawing Sheets

430
410
424
442
416
414
422
426
412
430

430
414
416
414
422
426
430

424
426
422

426
424

424
426

GARMENT HANGERS

TECHNICAL FIELD

This invention concerns garment hangers.

BACKGROUND OF THE INVENTION

Stores and shops use garment hangers to display garments on racks. For some garments a single size hanger can be used to display garments of different sizes. However, for garments, such as skirts and trousers, it is not possible to use a standard size hanger to fit onto the waist band of such garments. Various types of expandable hangers have been proposed and are in use but suffer from various disadvantages.

EPO548402A discloses a garment hanger having a generally central portion and garment support arms extending therefrom, the support arms each having a movable part slidably connected to the central portion for reciprocal movement to increase or decrease the length of the arms, wherein the movable parts of the arms are connected by a flexible link member such that extending movement of one movable part causes extending movement of the other moving part.

A significant disadvantage of available expandable hangers is the extent to which they are able to expand. Typically expandable hangers can go from 280 to 465 nun, which limits their usefulness. Other disadvantages include lack of strength at full extent and complexity, which increases the cost for an item generally, considered to be a throwaway.

SUMMARY OF THE INVENTION

An object of this invention is to provide an improved expandable garment hanger.

A garment hanger having a generally central portion and garment support arms extending therefrom, the support arms each having a movable part slidably connected to the central portion for reciprocal movement to increase or decrease the length of the arms, characterised by ends of the arms being connected by a flexible link member constrained against movement other than in line with the movable parts of the arms and arranged to reverse direction from its connection to one arm to the other arm, whereby extending movement of the movable part of one arm causes extending movement of the movable part of the other arm and pushing the movable part of one arm inwards causes retraction of the movable part of the other arm.

It is preferred that there are two such flexible link members such that extension or retraction of both arms may be achieved by pulling or pushing on either movable arm part.

Garment hangers of the invention preferably also include means for locking the arms thereof at a desired extension, such as a ratchet mechanism. A trigger means is preferably provided for disengaging the locking means for resetting the hanger arms to a different greater or lesser extension. A preferred locking mechanism comprises a series of teeth on one hanger part and one or more teeth on a movable arm part, wherein the respective teeth are shaped and arranged to permit movement over each other in extending the arm of the hanger but prevent movement to shorten the arm of the hanger, save for action of a release member. The release member is preferably on a separate arm associated with said movable arm part. The one or more teeth of the movable arm part are preferably on a resiliently movable arm part whereby the teeth are normally engaged with the series of teeth of the one hanger part. The release member preferably has a spigot or the like at or near one end arranged to be movable to disengage the respective sets of teeth by acting on the resiliently movable arm part of the hanger arm. Then, the release member is preferably movable between a first position where it does not act to disengage the respective sets of teeth and second position where it disengages the respective sets of teeth. The release member is preferably arranged to move with the movable arm as hanger is extended whilst captured in its first position, whereby it is ready to be moved to its second position to disengage the respective sets of teeth. The release member is preferably slidably captured on the movable arm part.

Garment hangers of the invention may be provided with waist band engaging end portions for use with trousers or skirts. On the other hand, the hanger of the invention may also be in a form suitable, for example, for jackets, dresses, pullovers.

In one preferred embodiment, ends of the hanger arms are shaped to suit waistbands of garments. In another preferred embodiment the hanger arms are shaped for carrying jackets, skirts and the like. In yet another preferred embodiment, ends of the hanger arms are provided with clip type fasteners for gripping a garment. The clips preferably comprise spring-loaded members arranged to trap a garment part therebetween.

The flexible link member is preferably a band, strip or the like which is anchored at one end to an inwards end of an extendable arm part and to an inwards end of the other extendable arm part via a pulley, roller, runner or the like spaced from the inward end of the first extendable arm whereby the link member returns in the opposite direction to the other extendable arm. When a second flexible link is present it is arranged in the opposite manner.

BRIEF DESCRIPTION OF THE DRAWINGS

Features of the present invention will now be further described, by way of example only, with reference to the accompanying drawings, in which.

DETAILED DESCRIPTION OF THE DRAWINGS AND PREFERRED EMBODIMENTS

Figure 1:
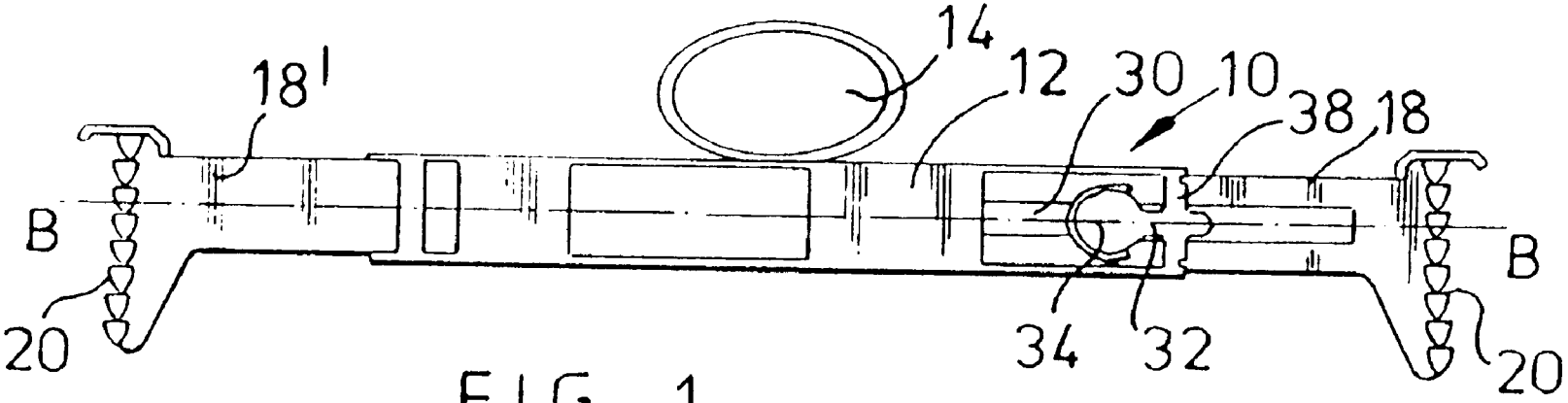
FIG. 1 shows a skirt hanger.
Figure 2:
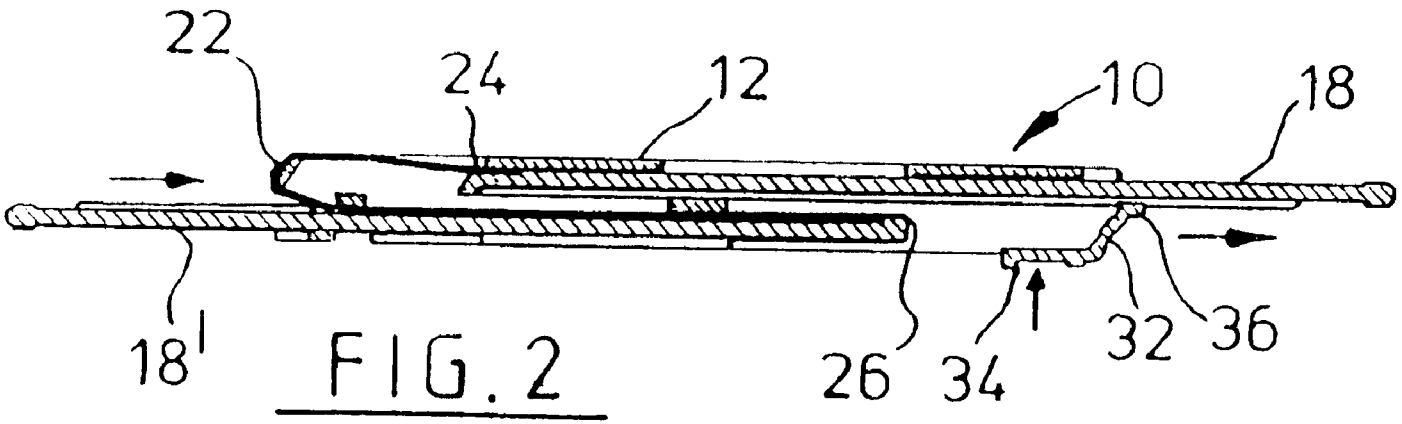
FIG. 2 is a section on line BB of FIG. 1.
Figure 3:
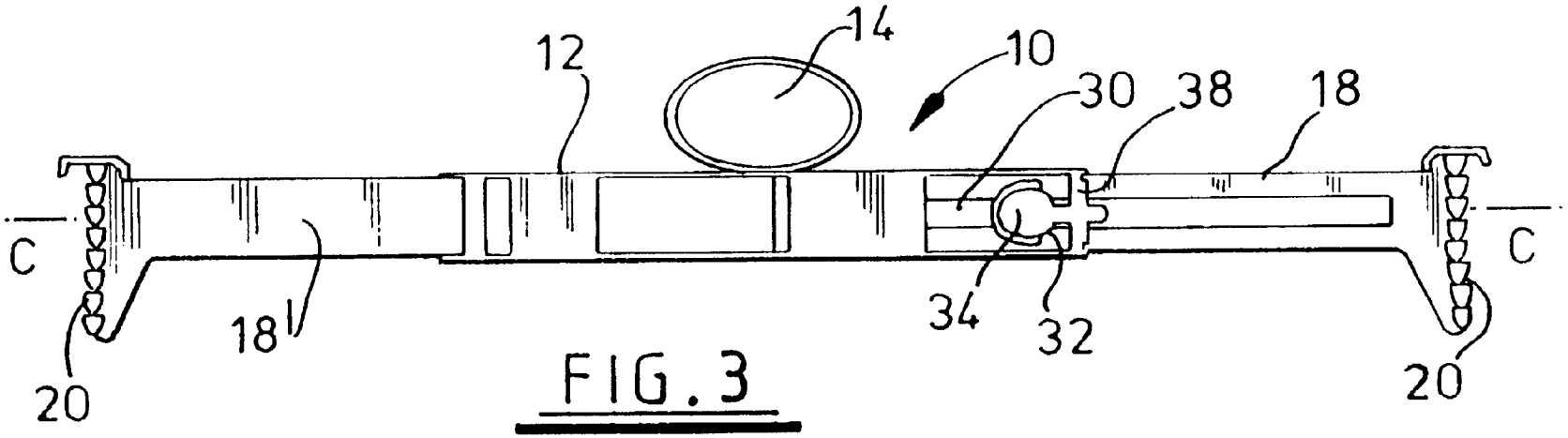
FIG. 3 shows the skirt hanger of FIG. 1 extended.
Figure 4:
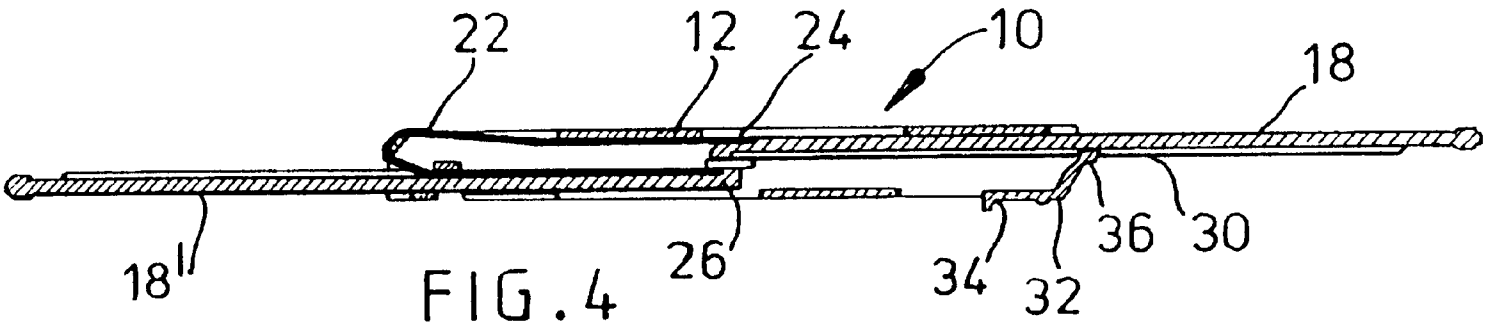
FIG. 4 is a section on line CC of FIG. 3.

Referring to FIGS. 1 to 4 of the accompanying drawings, a lightweight skirt hanger 10, has a narrow hollow main body 12 with a shield 14, extending from an edge, and into which a hook will usually be fixed. The shield will usually carry a with garment details thereon.

Within and extending oppositely from the body 12 are a pair of arms 18, 18'. Within the body the arms overlap but are free to slide past each other. At their outer ends the arms are shaped to provide gripping areas 20 for a waist band of a skirt.

A flexible link 22 is fixed to the inner end 24 of arm 18, passes around a part of the body 12 spaced from the end 24 of the arm 18 and returns to the inner end 26 of the other arm 18' to where it is fixed. The link 22 is thus arranged so that pulling the arm 18 outwards also causes the other arm 18' outwards to extend the distance between the gripping areas 20 of the hanger. To retract the arms, the arm 18' is pushed inwards and that, via the link 22 pulls the other arm 18 inwards.

The arm 18 has on its face towards the other arm a toothed rack 30 and a part 32 of the body forms a member to engage with the track and prevent the arm retracting once it has been extended to a desired amount. Teeth of the rack and part 32 are arranged to pass over each other when the arms are being extended.

The member 32 has a first part 34 which can be depressed in order to disengage its second part 36 from the rack 34. The two parts are either side of a flexible hinge 38 formed as part of the body.

Figure 5:
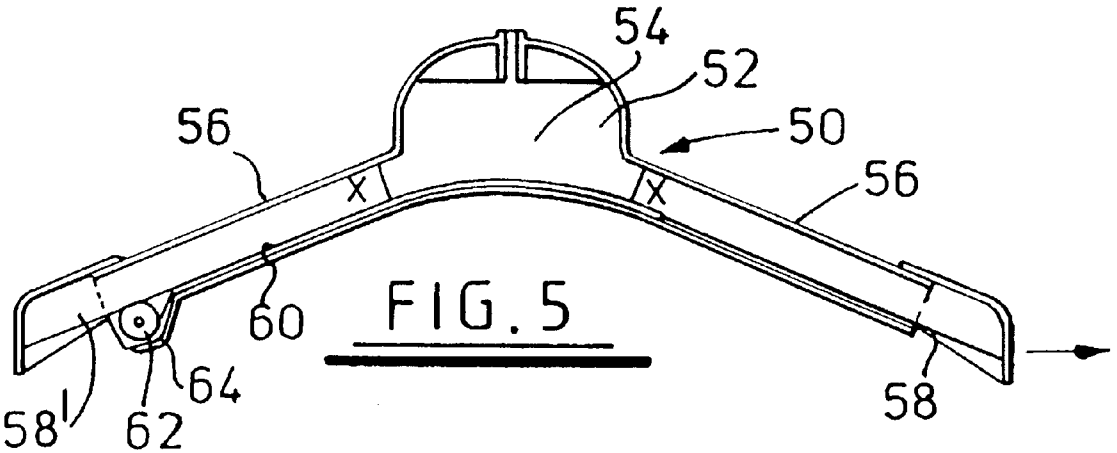
FIG. 5 shows a jacket hanger.
Figure 6:
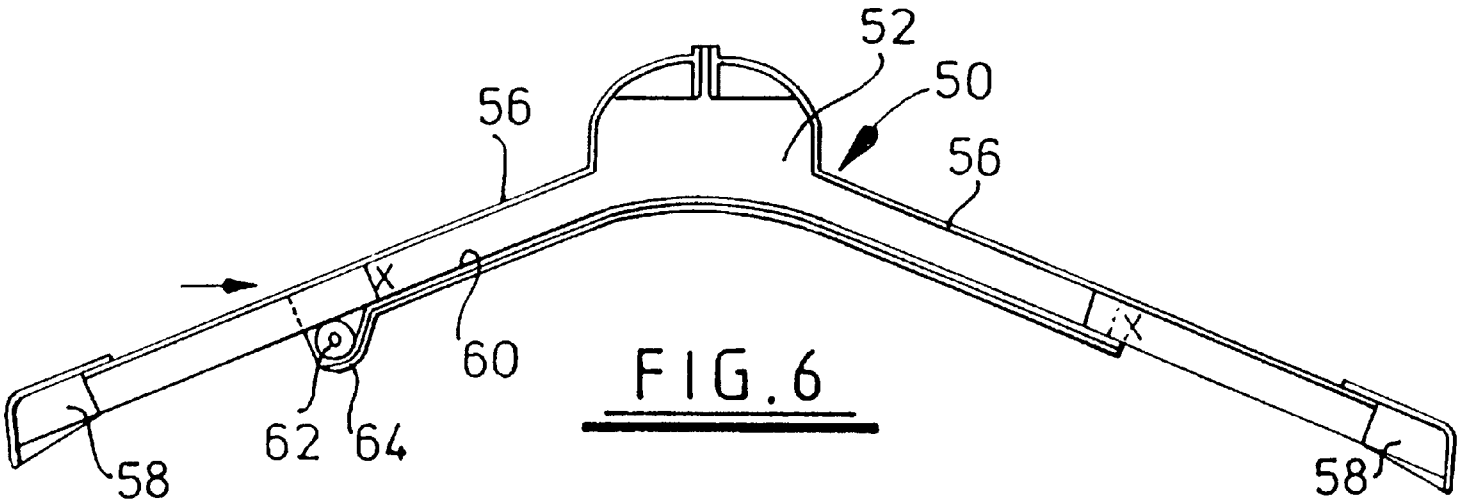
FIG. 6 shows the hanger of FIG. 5 extended.

In FIGS. 5 and 6, a jacket hanger 50 has a central body 52 forming a shield 54 and a pair of hollow oppositely extending arms 56. A hook will normally be fixed into the top of the shield 54. Within each arm 56 is a slidable arm extension 58, 58'. A flexible link 60 extends from the inner end of one arm extension 58 through the body around a pulley 62 in a pocket 64 of the opposite arm 56 and back to the inner end of the other arm extension 58'.

The link 60 is such that the width of the hanger can be extended by pulling on the right arm extension 58, which action causes the other arm extension 58' to slide outwards. To retract the arm extension the left arm extension 58' is pushed inwards, so that the link pulls the other arm extension 58 inwards.

Figure 7:
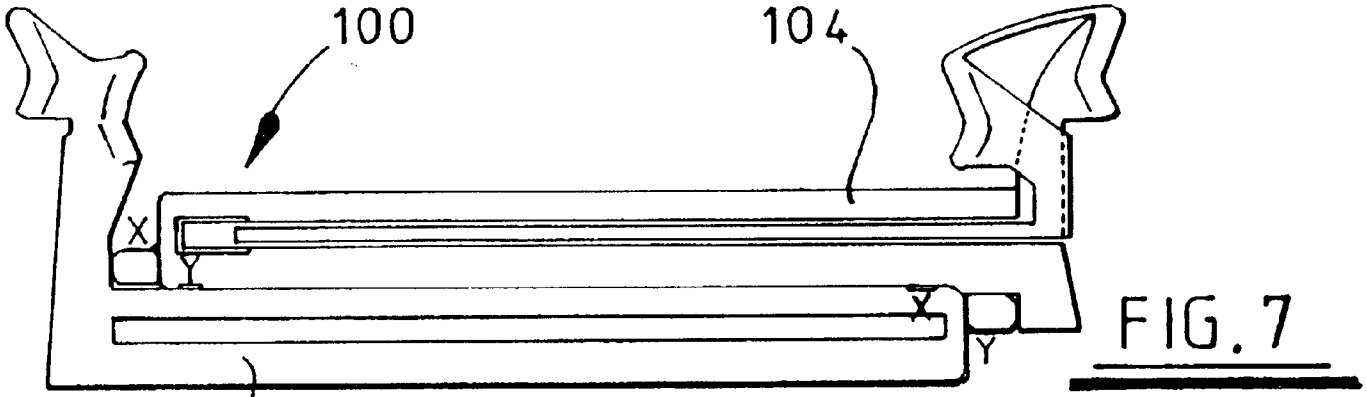
FIG. 7 shows another skirt hanger.
Figure 8:
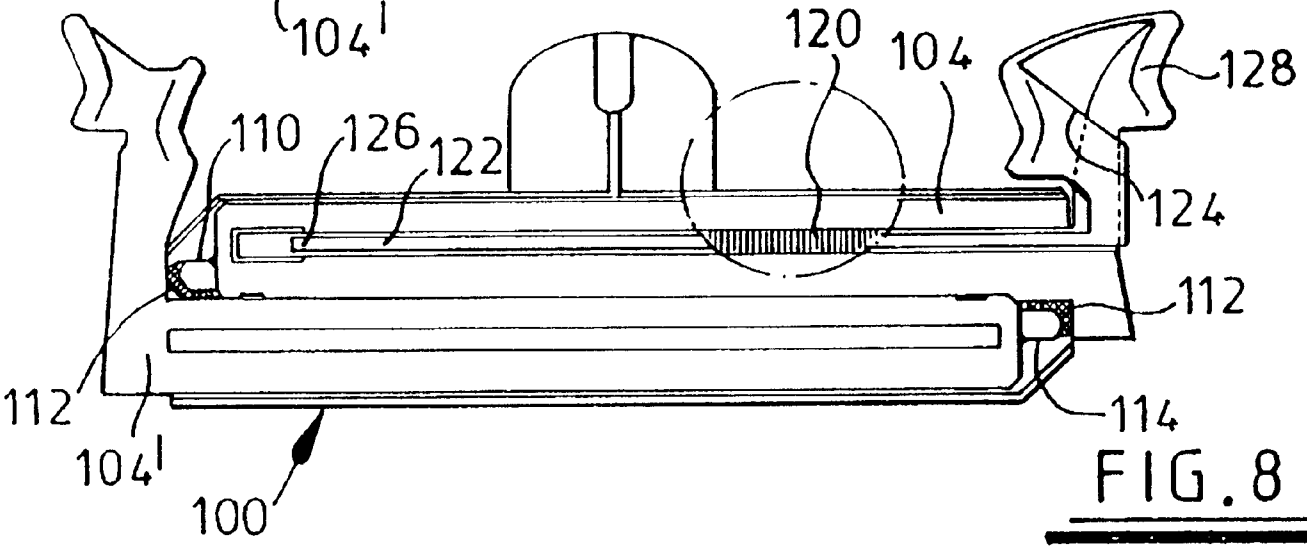
FIG. 8 also shows the hanger of FIG. 7 with further detail.

The embodiments of FIGS. 1 to 4 and 5 and 5 have a single link, so that extension and retraction can only be performed by action on one arm respectively. FIGS. 7 and 8 illustrate a hanger with a double link, so that extension and retraction can be achieved by action on either arm of the hanger.

FIGS. 7 and 8 show a hanger 100 without its cover at all in FIG. 7 and with only the rear side of its cover shown in FIG. 8. The hanger has a pair of arms 104, 104' arranged for opposed sliding movement within the cover.

A first flexible link 110 is connected at X to one end of arm 104 and extends over runner 112 beyond the end of the arm back to the opposite end of the other arm 104' where it is connected at X. A second flexible link 114 is arranged oppositely between the points indicated at Y on each of the arms 104, 104'. Thus, when either arm 104, 104' is pulled outwards or pushed inwards one or other of the links 110 and 114 will act to cause the corresponding movement of the other arm either to extend or reduce the width of the hanger respectively.

One arm 104 has a toothed rack 120 along its face and the hanger includes an elongate bar 122 with a trigger 124 at one end outside of the cover and a toothed part 126 at its other end to engage the rack to lock the arms at a desired extended position when the arms are being extended the part 126 passes over the rack 120. The trigger 124 is linked to an oppositely oriented trigger 128. Squeezing the trigger parts together disengages the toothed part 126 from the rack allowing one or other of the arms to be pushed inwards to retract both arms.

Figure 9:
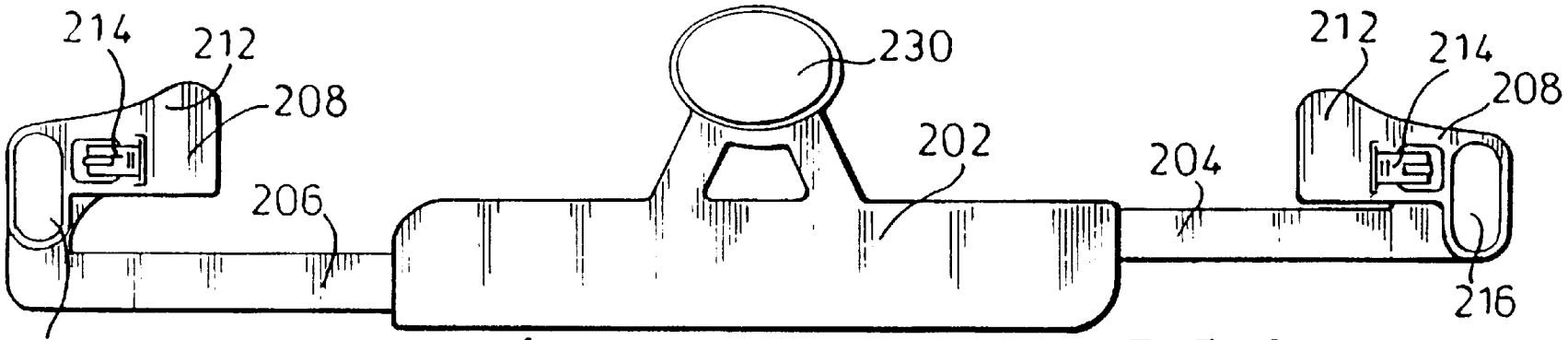
FIG. 9 shows a clip hanger from one side expanded.
Figure 10:
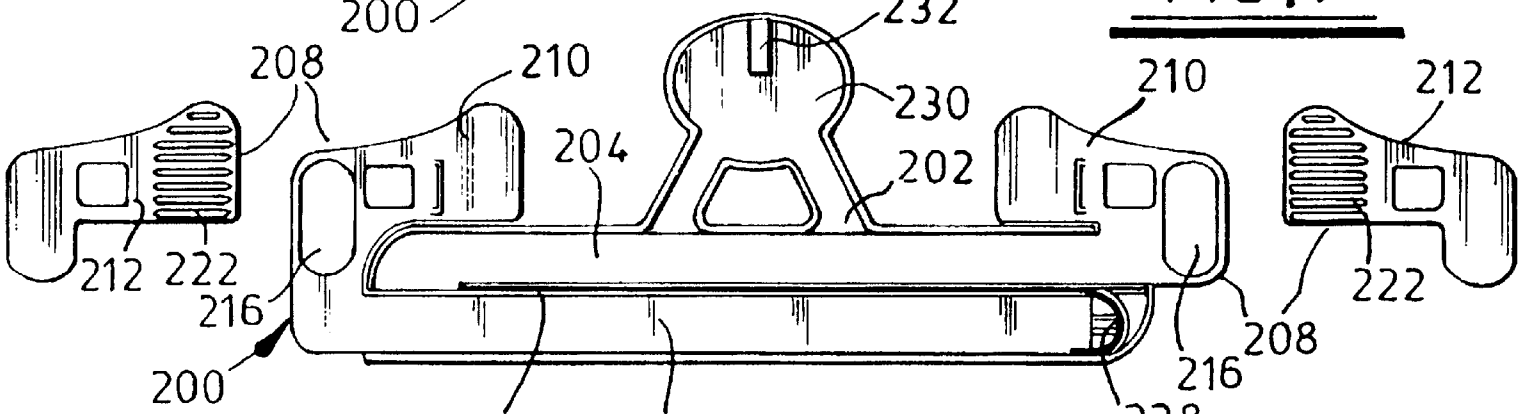
FIG. 10 shows the clip hanger of FIG. 10 from the opposite side with cover removed and retracted.
Figure 11:
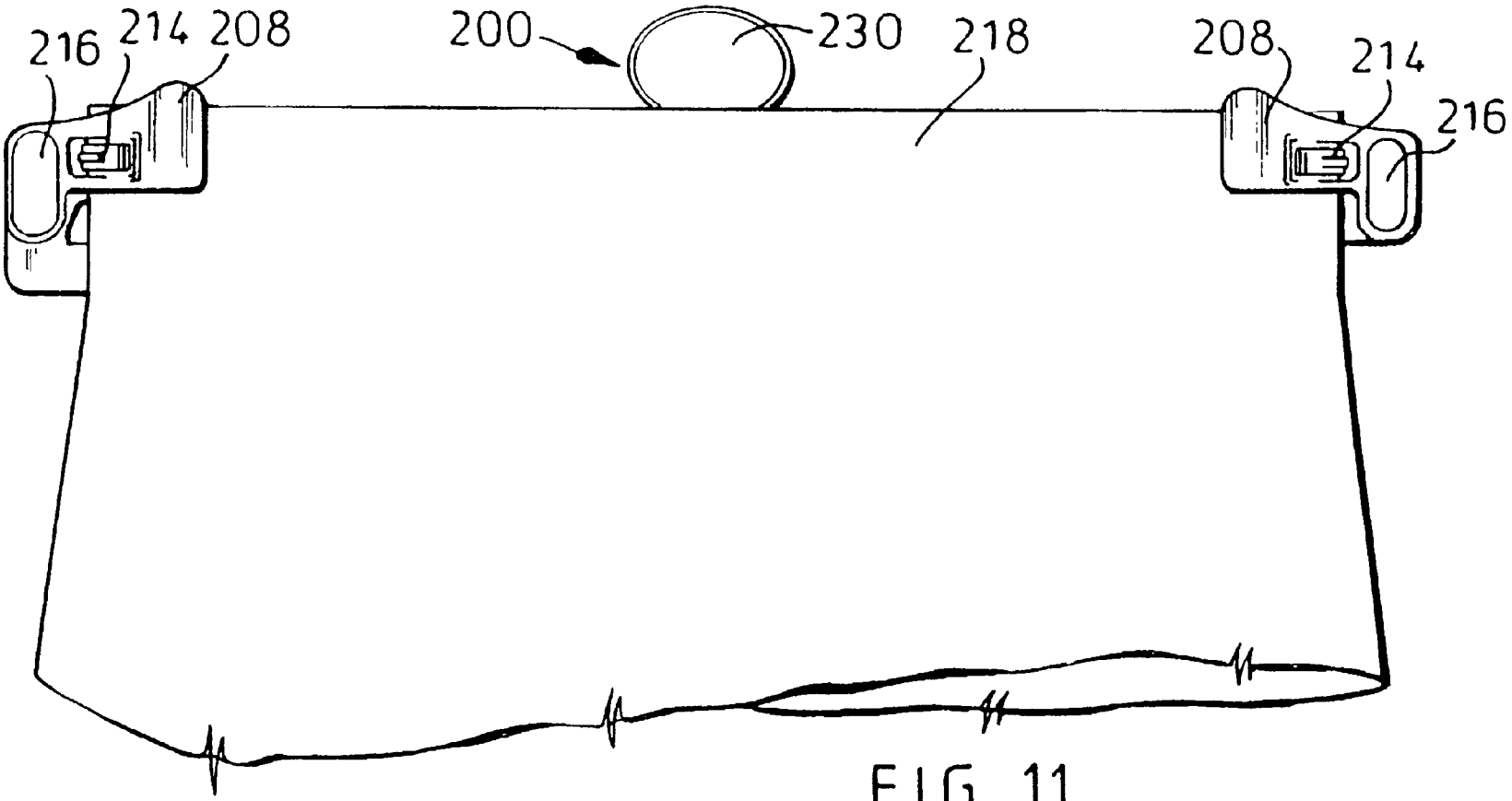
FIG. 11 shows the clip hanger of FIGS. 9 and 10 in use.

Turning to FIGS. 9, 10 and 11 of the accompanying drawings, a clip hanger 200 has a main body 202 and a pair of arms 204, 206 slidably mounted within the body for movement in opposite directions. At their free ends the arms 204, 206 have a clip 208 comprising a fixed jaw 210 and a movable jaw 212 connected by a U-shaped spring clip 214 through holes in the jaws, whereby the jaws are urged together. Finger pads 216 on each jaw can be squeezed together to open the jaws for insertion of a garment 218. The jaws 210 and 212 have ridges 222 on their facing surfaces for providing grip on the garment.

The arms 204, 206 are slidable in channels of the body and are connected by a flexible strip 226. The strip 226 extends from the end of the upper arm 204 passes around an arcuate surface runner 228 and connects to the end of the lower arm 206. The arrangement is such that as one arm is pulled outwards longitudinally of the body the flexible strip is pulled with it and hence pulls the other arm outwards in the opposite direction to the first arm. Thereby the arms are extended and hence the length of the hanger. Conversely pushing one arm back into the body causes the other arm to be pulled in the opposite direction back into the body.

The body 202 has a shield 230 for a label to be attached giving product information and a boss 232 behind the shield for receiving a metal hook (not shown) for supporting the hanger on a rail.

Figures 12, 13:
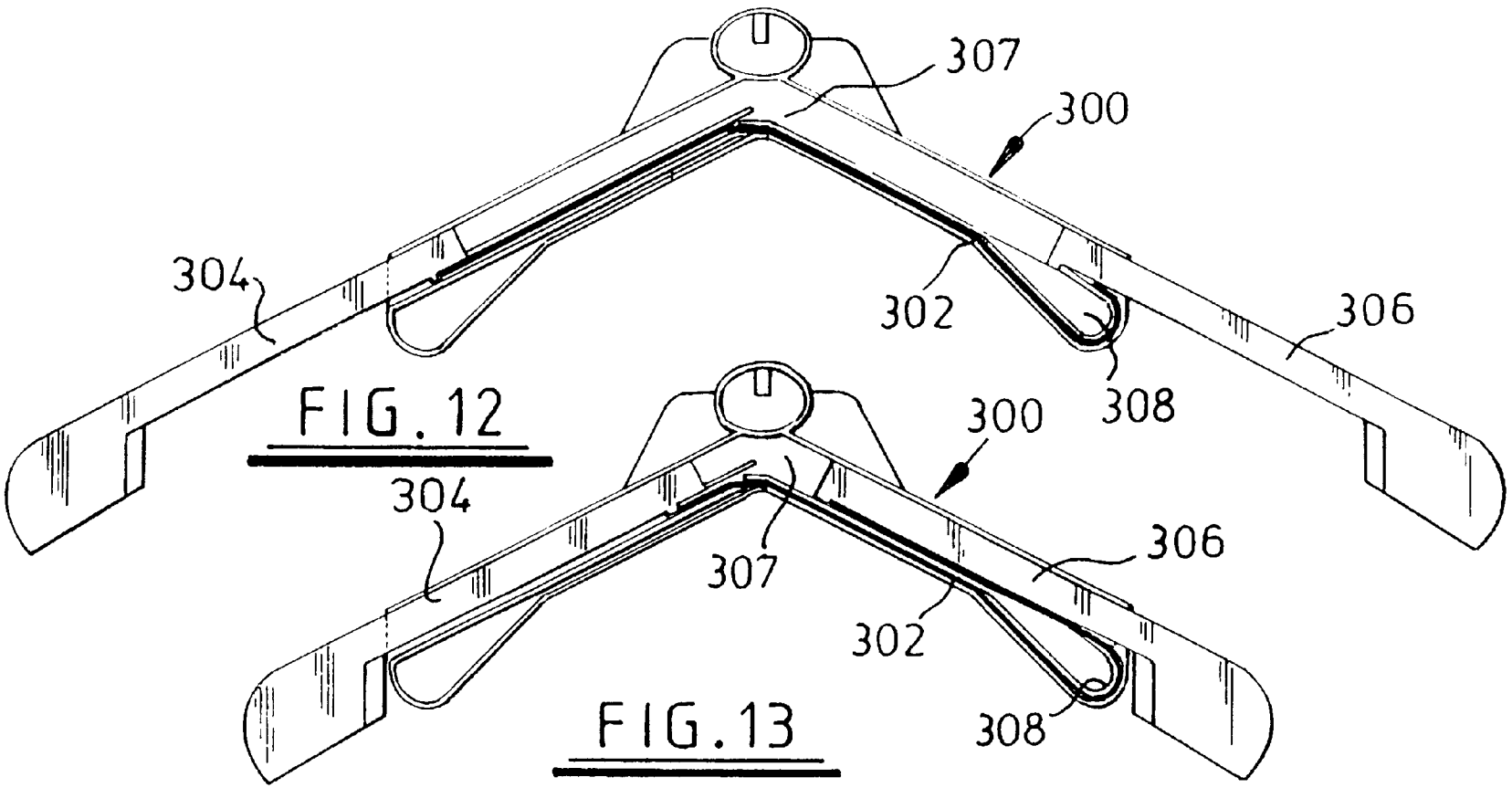
FIG. 12 shows another hanger for jackets and the like with front removed and expanded.
FIG. 13 shows the hanger of FIG. 12 retracted.
Figure 14:
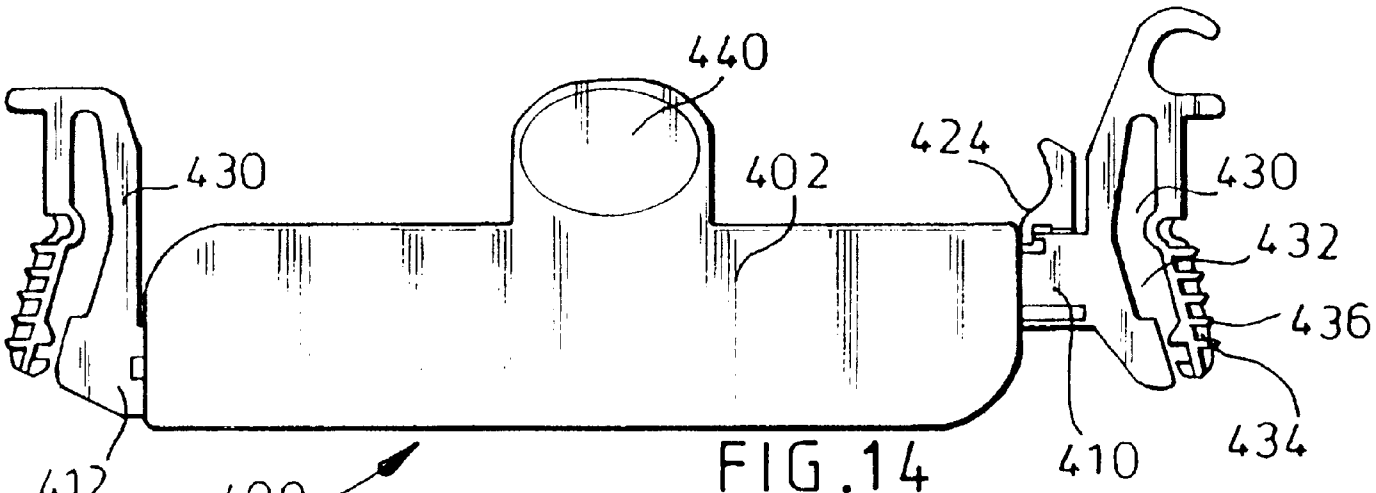
FIG. 14 shows another skirt hanger retracted.
Figure 15:
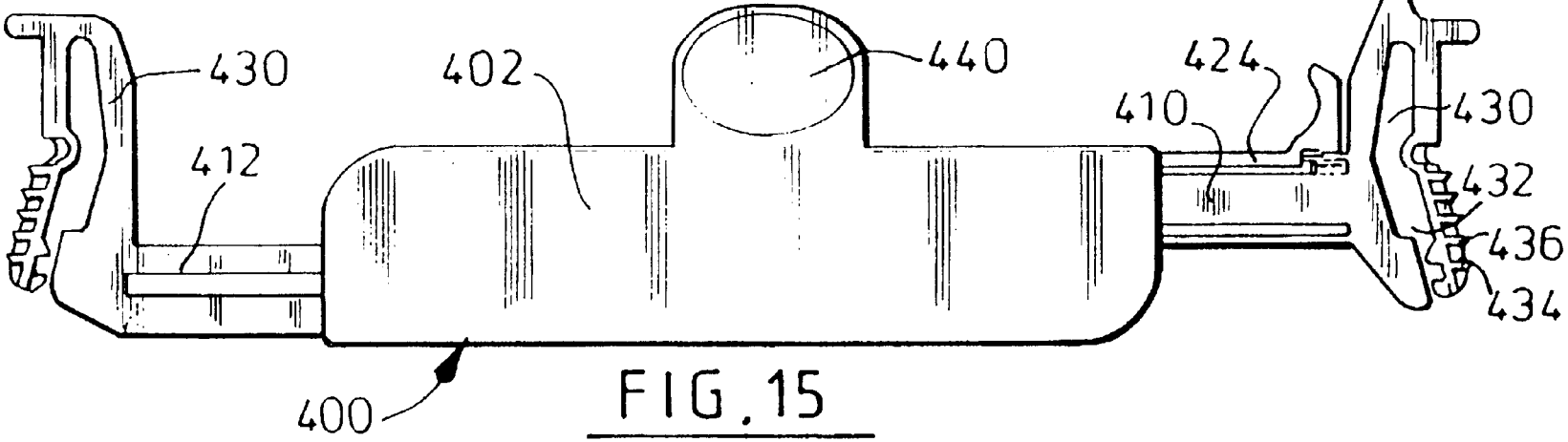
FIG. 15 shows the hanger of FIG. 14 expanded.
Figures 16, 17, 18A, 18B, 18C:
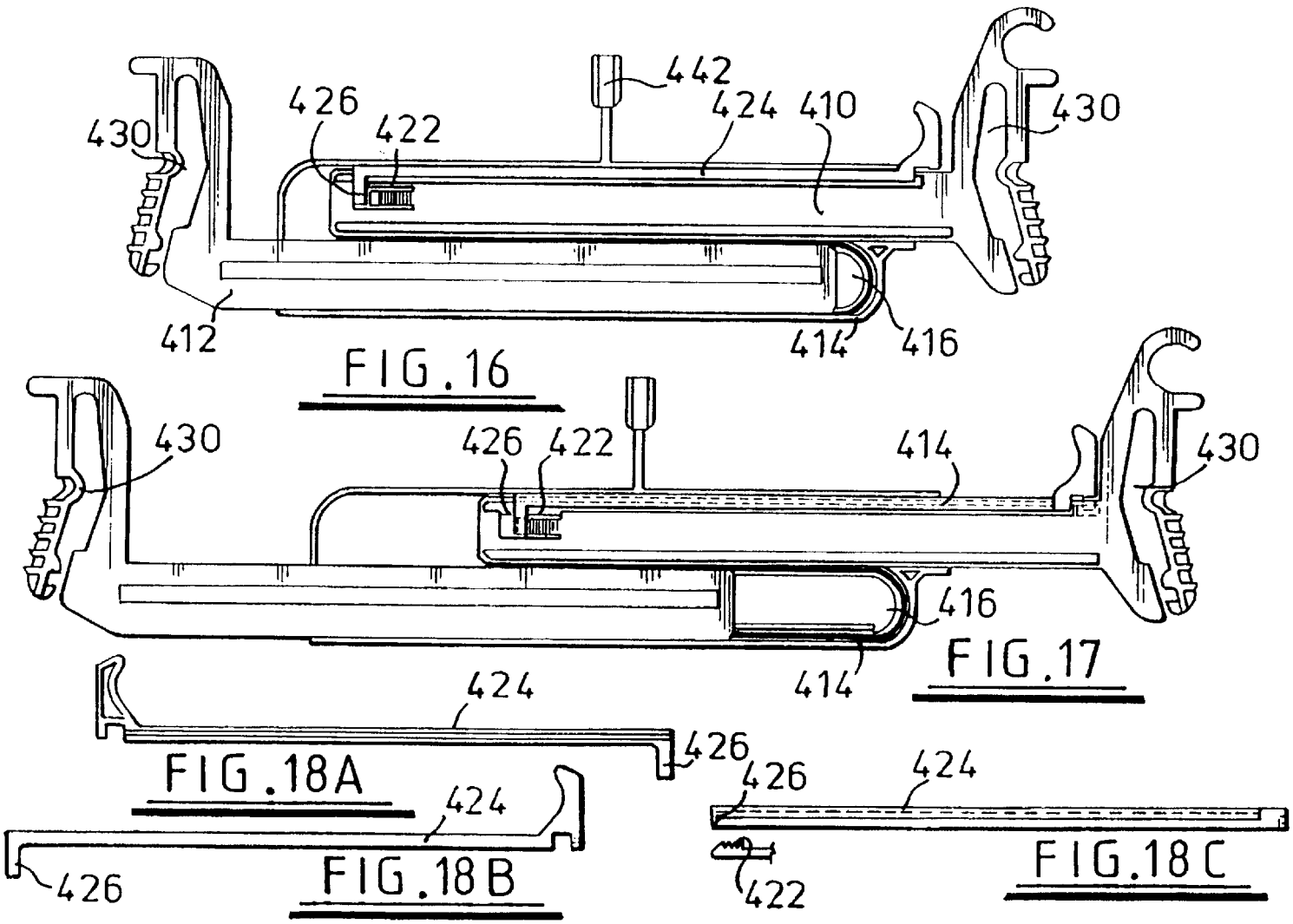
FIG. 16 shows the interior of the hanger of FIGS. 14 and 15 retracted.
FIG. 17 shows the interior of the hanger of FIGS. 14 and 15 retracted.
FIGS. 18A, B and C are rear, front and bottom views of a release trigger for the hanger of FIGS. 14 to 17.
Figure 20:
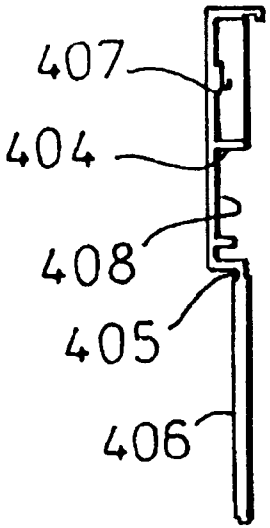
FIG. 20 is a section on line DD of FIG. 19.
Figure 19:
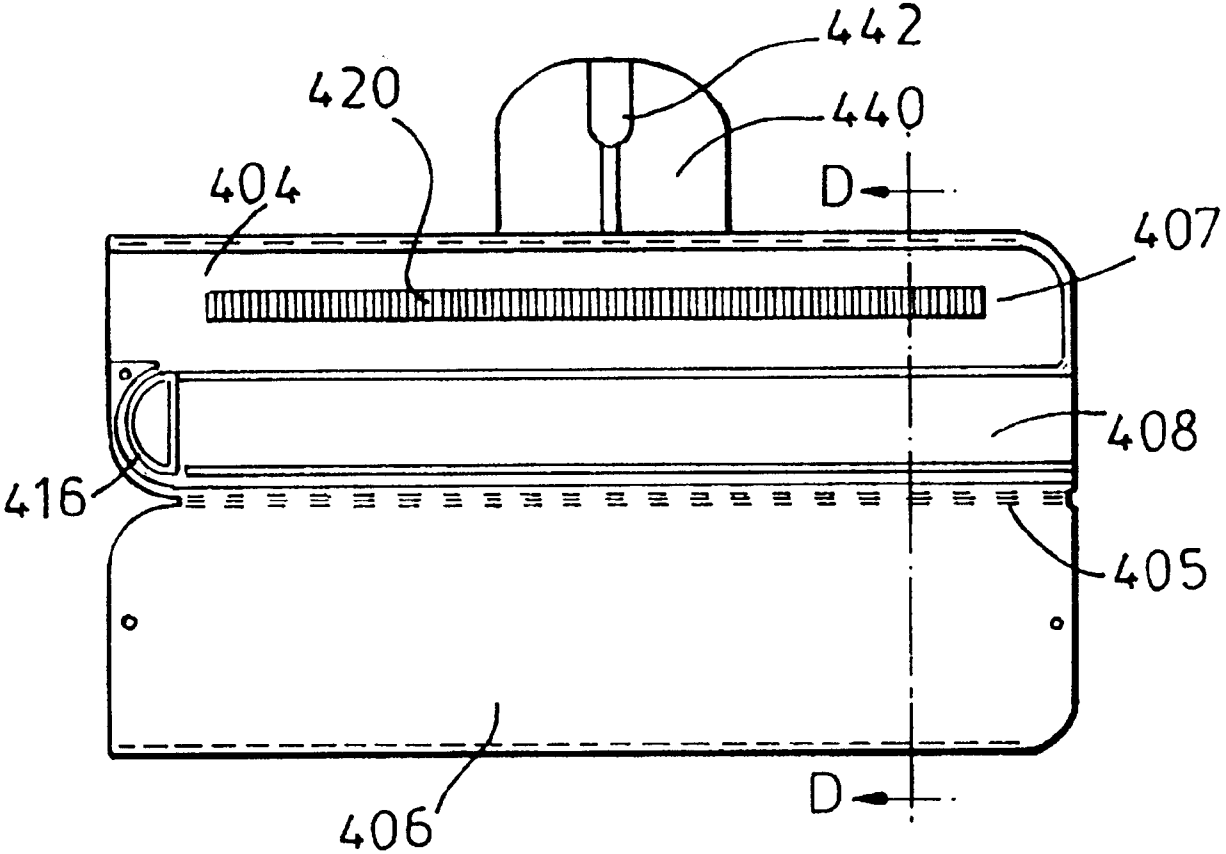
FIG. 19 shows a main body for the hanger of FIGS. 14 to 17.

FIGS. 12 and 13 of the accompanying drawings show a jacket hanger 300 similar to that of FIGS. 5 and 6 except that there is no pulley for guiding the flexible strip 302 connecting the ends of arms 304 and 306. Instead, the strip 302 passes around a curved runner 308 moulded into the hanger body 307. The body 307 has two limbs 314, 316 providing channels for the arms to slide in and the strip 302 is guided in narrow channels 318, 320 in each limb. The hanger 300 operates in the same way. By pulling out one arm 304 in one direction to extend the length of the hanger on one side, the other arm 306 is urged outwards to extend the length of the hanger on the other side.

Finally, FIGS. 14 to 20 show a skirt hanger 400. The hanger 400 has a body 402 formed from two plates 402, 404, which as shown (see FIGS. 19 and 20) are hinged connected by a thinning of connecting material 405 between them but they may be separate pieces. The plates 404, 406 form between them a pair of channels 407, 408 in which are slidably arranged hanger arms 410 and 412 respectively on top of each other for movement in opposed directions to lengthen or shorten the hanger. Ends of the arms 410 and 412 are connected by a flexible strip 414 that extends under the top arm 410 around a runner 416 and under the end of the bottom arm 412, so that when one arm is pulled out, the other arm moves outwards oppositely and vice versa.

In order to hold the arms at a desired position, the inside surface of the plate 404 has a row of ratchet teeth 420 and the top arm 410 has a deflectable pawl 422 at its inner end, the pawl having teeth thereon that can slip over the teeth 420 when the arm is pulled outwards but not when the arm is pushed inwards, thereby locking the arms against inwards movement. The pressure of the plate 406 when fixed onto the plate 404 urges the pawl into engagement with the teeth 420.

To release the locking arrangement, a release trigger 424 is slidably associated with the top arm 410 and has a finger 426 at one end that by pulling on the trigger 424 separate the pawl 422 from the teeth 420 allowing the top arm 410 to be pushed inwards.

The outer ends of the arms 410, 412 are provided with formations 430 to engage a waistband of a skirt, trousers or the like. The formations 430 have downwardly open slots 430 to provide resilient fingers 434 with gripping shaping 436 thereon.

The body 402 has a shield area 440 which includes a boss 442 to receive a metal hook (not shown) for supporting the hanger on a rail or rack.

It is believed that with arrangements according to the invention, garment hangers that can cover a width range of 230 to 495 mm can be produced.

What is claimed is:

1. A garment hanger having a generally central portion and a pair of garment support arms extending therefrom, the support arms each having a movable part slidably connected to the central portion for reciprocal movement to increase or decrease the length of the arms, characterized by inwards ends of the movable parts being connected by at least one flexible link member constrained against movement other than in line with the movable parts of the arms and arranged to reverse direction once from its connection to one inwards end to its connection to the other inwards end, such that extending movement of the movable part of one arm causes extending movement of the movable part of the other arm and pushing the movable part of one arm inwards causes retraction of the moveable part of the other arm.

2. A garment hanger as claimed in claim 1 comprising two such flexible link members whereby extension or retraction of both movable parts of the arms may be achieved by pulling or pushing on either arm.

3. A garment hanger as claimed in claim 1 also including means for locking the movable parts of the arms thereof at a desired extension.

4. A garment hanger as claimed in claim 3 comprising means for disengaging the locking means for resetting the movable parts of the arms to a different greater or lesser extension.

5. A garment hanger as claim 4 wherein the locking means comprises a ratchet mechanism.

6. A garment hanger as claimed in claim 5, wherein the ratchet mechanism comprises a row of teeth on a fixed part of the hanger and a deflectable pawl on the movable part of one arm of the hanger, the pawl being slidable over the teeth in one direction to allow extension of the hanger but not the other by engagement therewith.

7. A garment hanger as claimed in claim 6, further comprising trigger means for deflecting the pawl away from engagement with the teeth to permit retraction of the movable parts of the hanger arms.

8. A garment hanger as claimed in claim 1 having waistband engaging end portions on the support arms for use with trousers or skirts.

9. A garment hanger as claimed in claim 1 having clips on ends of the support arms for holding a garment.

10. A garment hanger as claimed in claim 1 wherein the arms are shaped for use with jackets.

11. A garment hanger as claimed in claim 1 wherein the flexible link member is a band or strip which is anchored at one end to an inwards end of a movable arm part and to an inwards end of the other movable arm part via a pulley, roller or runner spaced from the inward end of the first movable arm, whereby the link member returns in the opposite direction to the other movable arm.

12. A garment hanger as claimed in claim 11, wherein when a second flexible link is present it is arranged in the opposite manner to the aforesaid flexible link.

13. A garment hanger as claimed in claim 3 also including means for locking the movable parts of the arms thereof at a desired extension.

14. A garment hanger as claimed in claim 13 further comprising means for disengaging the locking means for resetting the movable parts of the arms to a different greater or lesser extension.

15. A garment hanger as claimed in claim 14 wherein the locking means comprises a ratchet mechanism.

16. A garment hanger as claimed in claim 15 wherein the ratchet mechanism comprises a row of teeth on a fixed part of the hanger and a deflectable pawl on the movable part of one arm of the hanger, the pawl being slidable over the teeth in one direction to allow extension of the hanger but not the other by engagement therewith.

17. A garment hanger as claimed in claim 16 further comprising trigger means for deflecting the pawl away from engagement with the teeth to permit retraction of the movable parts of the hanger arms.

18. A garment hanger as claimed in claim 17 having waistband engaging end portion on the support arms for use with trousers or skirts.

19. A garment hanger as claimed in claim 17 having clips on ends of the support arms for holding a garment.

20. A garment hanger as claimed in claim 17 wherein the arms are shaped for use with jackets.

21. A garment hanger as claimed in claim 18 wherein each flexible link members is a band or strip and one flexible link member is anchored at one end to an inwards end of a movable arm part and to an inwards end of the other movable arm part via a pulley, roller or runner spaced from the inwards end of the first movable arm, such that the link member returns in the opposite direction to the other movable arm, and the second flexible link member is arranged in the opposite manner to the aforesaid flexible link member.

22. A garment hanger as claimed in claim 19 wherein each flexible link members is a band or strip and one flexible link member is anchored at one end to an inwards end of a movable arm part and to an inwards end of the other movable arm part via a pulley, roller or runner spaced from the inwards end of the first movable arm, such that the link member returns in the opposite direction to the other movable arm, and the second flexible link member is arranged in the opposite manner to the aforesaid flexible link member.

23. A garment hanger as claimed in claim 20 wherein each flexible link members is a band or strip and one flexible link member is anchored at one end to an inwards end of a movable arm part and to an inwards end of the other movable arm part via a pulley, roller or runner spaced from the inwards end of the first movable arm, such that the link member returns in the opposite direction to the other movable arm, and the second flexible link member is arranged in the opposite manner to the aforesaid flexible link member.

* * * * *